US005626693A

United States Patent [19]

Yao et al.

[11] Patent Number: 5,626,693

[45] Date of Patent: May 6, 1997

[54] METHOD AND APPARATUS FOR QUENCHING A TUBULAR WORKPIECE

[75] Inventors: Yugo Yao; Tetsukazu Fukuhara; Yoshiki Seto; Junichi Kato, all of Hiratsuka, Japan

[73] Assignee: Neturen Co., Ltd., Tokyo, Japan

[21] Appl. No.: 504,755

[22] Filed: Jul. 19, 1995

[51] Int. Cl.[6] ..... C21D 9/08; C21D 1/667

[52] U.S. Cl. ..... 148/594; 148/519; 148/647; 266/117

[58] Field of Search ..... 148/590, 594, 148/519, 646, 647; 266/117, 114

[56] References Cited

U.S. PATENT DOCUMENTS

| | | | |
|---|---|---|---|
| 4,050,963 | 9/1977 | Kunioka et al. . | |
| 4,461,462 | 7/1984 | Mizushima et al. . | |
| 5,492,308 | 2/1996 | Yao et al. | 148/646 |

FOREIGN PATENT DOCUMENTS

| | | | |
|---|---|---|---|
| 0079621 | 5/1983 | European Pat. Off. . | |
| 0172250 | 2/1986 | European Pat. Off. . | |
| 0628641 | 7/1994 | European Pat. Off. . | |
| 0628641 | 12/1994 | European Pat. Off. . | |
| 2602678 | 8/1976 | Germany . | |
| 9001640 | 4/1990 | Germany . | |
| 4316795 | 11/1994 | Germany . | |
| 54-67504 | 5/1979 | Japan . | |
| 5582725 | 6/1980 | Japan | 266/117 |
| 57-192221 | 11/1982 | Japan . | |

*Primary Examiner*—Deborah Yee
*Attorney, Agent, or Firm*—Wenderoth, Lind & Ponack

[57] ABSTRACT

This invention provides a method and apparatus for quenching a tubular workpiece such as cylindrical tubes or different-shaped tubes, which are difficult to be exerted constraining force for preventing warping especially in case of thinner thickness. Warping is prevented by applying a constraining force which is increased from beginning of the quenching to termination thereof, corresponding to increase of elasticity limit stress in accordance with temperature drop of the workpiece. Furthermore, apparatus for carrying out the method for quenching a tubular workpiece are offered, wherein the apparatus are provided with a pressure controller for pressure rolls or dies, thereby the pressure controller changes setting input for the pressure during the quenching.

13 Claims, 7 Drawing Sheets

METHOD AND APPARATUS FOR QUENCHING A TUBULAR WORKPIECE

FIELD OF THE INVENTION

The present invention relates to a method and an apparatus for quenching a tubular workpiece such as cylindrical tubes or different-shaped tubes, and especially to a method and an apparatus which are preferably applicable to those of thinner thickness for which it is difficult to provide means to prevent warping during quenching.

BACKGROUND ART

In case of quenching a tubular workpiece as a thin cylindrical tube, for instance the thickness of which is 3 millimeters, there is a problem that the workpiece is very likely to warp and the diameter thereof may be subjected to change. Methods by which a workpiece is quenched with some constraining force have been already known as means for preventing warping during quenching. However, because of being thin, there are such problems that a portion of the workpiece applied the constraining force becomes concave and that the workpiece is elongated in a longitudinal direction by the constraining force of a diametral direction.

There is a Japanese laid-open patent No. Sho 57-192221 as a prior art for quenching a thin tubular workpiece wherein the present invention relates. According to this method, a tubular workpiece is rotatably supported by both of the end faces, and is made expansible and contractible in the axial direction in heating and cooling processes. And then, groups of rotary disks which are brought into contact with the workpiece at intervals in the longitudinal direction are pressed to the workpiece from two orthogonal directions, thereby it is prevented from warping and at the same time from dimensional changes by controlling cooling rate. But in this method unless the pressure is sufficiently controlled, the diameter of the workpiece may be partially constricted, because the rotary disks are brought into contact with the workpiece at intervals in the longitudinal direction.

Furthermore, in Japanese laid-open patent No. Sho 54-67504, it is disclosed that a round bar is quenched while it is put among three rolls having a length identical thereto and it is rotated. However, in a case where this method is used for a thin tube, such a phenomenon that the tube diameter is reduced and the tube length is elongated may occur under usual pressure of rolls for preventing the tube from warping.

Still furthermore, as for a bar workpiece of different shape such as a rack is formed on its side, the above method cannot be adopted wherein the workpiece is rotated while quenching. In this case press quenching has been conventionally applied as a method for preventing warping during quenching. According to this method, all or part of a workpiece, which is heated to appointed hardening temperature, is pressed in dies having concave portions of appointed shape, and is placed in a cooling liquid tank. Recently, there are cases where a bar workpiece which a rack is formed therealong is made hollow and tubular for the purpose of making automobiles lighter. In these cases, there may be a possibility for such a workpiece being collapsed by compressive force in the above press quenching.

Formerly, the inventors of the present invention have improved the press quenching and have invented an apparatus wherein dies are brought into contact with each other when they are closed, therefore no pressure is exerted to the workpiece in the dies (International laid-open patent: 94/14985, EPC laid-open patent No. 0628641). In this apparatus, no pressure is exerted to a workpiece when the workpiece is still soft at high temperature just after the beginning of the quenching and warping is prevented by constraining force of dies when the workpiece is caused to warp due to cooling.

It is a theme of the present invention that no collapse nor change in diameter occur, wherein constrained quenching is carried out in order to prevent warping of the tubular workpiece. A method and an apparatus of this invention must be applicable not only to a tubular workpiece of cylindrical tube, but also that of a different shape which has a flat side extending therealong and so on. Also it is an object of the present invention to provide a method and an apparatus which are superior to the former invention in capacity to prevent warping during quenching.

SUMMARY OF THE INVENTION

It is an object of the present invention to provide a method and an apparatus capable of quenching a tubular workpiece without warping or collapsing the workpiece. The method according to the present invention is that warping during quenching is prevented by applying constraining force, wherein the constraining force is increased from beginning of the quenching to termination thereof, corresponding to increase of elasticity limit stress in accordance with temperature drop of the workpiece. Preferably the constraining force does not exceed 20%, more favorably 5 to 15%, of the elasticity limit stress at respective temperature of the workpiece.

The above method for quenching a workpiece is further embodied by following means. The constraining force is changed depending on lapsed time of the quenching so that a ratio of the constraining force to the elasticity limit stress is maintained in a determined range, whereby relation between the temperature of the workpiece and the lapsed time of the quenching is obtained in advance. An another means is that the constraining force is changed depending on the temperature of the workpiece so that a ratio of the constraining force to the elasticity limit stress is maintained in a determined range, whereby the temperature of the workpiece is measured during the quenching.

The present invention also offers suitable apparatus for carrying out the above methods. The apparatus for quenching a tubular workpiece according to the present invention comprises plural rolls which are in contact continuously or intermittently along with a length of the workpiece at three or more points on a circumference thereof; and a cooling means for supplying cooling liquid to the workpiece, wherein at least one of the rolls is provided with a pressing means, wherein the pressing means is provided with a pressure controller which controls the pressure by changing setting input for the pressure during the quenching.

Another type of the apparatus according to the present invention comprises a set of dies which are removably mounted to a press in order to press the workpiece, wherein plural projections and plural recesses are formed on inner faces of each of the dies; and cooling liquid blow holes formed in at least one of the dies and opening into the recesses, wherein the press is provided with a pressure controller which controls the pressure by changing setting input for the pressure during the quenching.

Each of the above apparatus for quenching a tubular workpiece is further embodied by following means. The apparatus further comprises a pressure signal generating means for the setting input, wherein value of the pressure signal changes depending on lapsed time of the quenching.

Another means is that the apparatus further comprises a thermometer for measuring temperature of the workpiece and a pressure signal generating means for the setting input wherein value of the pressure signal depends on the temperature by the thermometer.

DETAILED DESCRIPTION OF THE INVENTION

In the present invention, constraining force in quenching is changed corresponding to increase of elasticity limit stress due to temperature drop of the workpiece. Thereby, warping of the workpiece can be prevented by only remarkably smaller force than that in the conventional press quenching, therefor no collapse due to the constraining force occur in the tubular workpiece. Elasticity limit of material remarkably changes depending on the temperature. As shown an example in FIG. 2, the elasticity limit stress decreases in accordance with temperature rise and becomes remarkably low around 800° C. On the other hand, the elasticity limit stress again increases by temperature drop in the quenching, and it becomes higher than of the same temperature in the heating due to hardening by the quenching. Therefore, in the present invention, the quenching is carried out by maintaining the constraining force within a range of the elasticity limit, whereby the constraining force is increased from beginning to termination of the quenching corresponding to increase of the elasticity limit in accordance with the temperature drop of the workpiece. The above process makes possible to exert the workpiece effective constraining force with preventing collapse of the workpiece, thereby the constraining force corresponds to the increase of strength due to cooling, and then makes possible to prevent warping during quenching. For this purpose, a value of load ratio =load stress/elasticity limit stress, is introduced, then the quenching is carried out by maintaining this value within a predetermined range regardless of the temperature.

Figure 1:
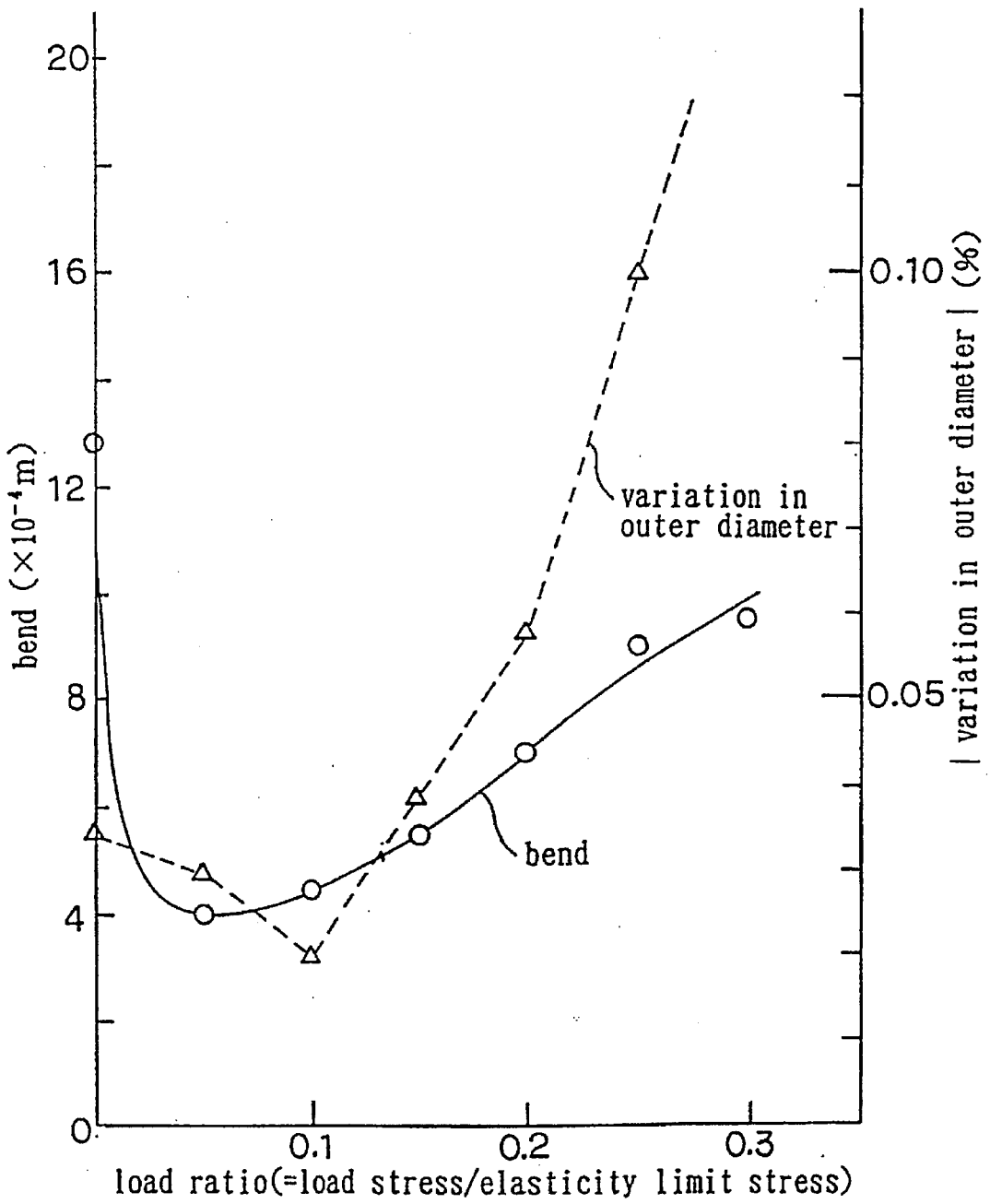
FIG. 1 is a graph showing relation between bend of a workpiece, variation in outer diameter and load ratio of constraining force.

FIG. 1 is a graph showing relation between bend, variation in outer diameter and load ratio, in quenching a thin steel tube with constraining by rolls. Although the bend is large when the load ratio is zero with no constraining force exerted, it decreases when constraining force is added, but the bend gradually increases when the load ratio increases furthermore with the constraining force exerted. On the other hand, the variation in outer diameter is little when the load ratio is small, but it increases remarkably when the load ratio exceeds a certain value. It is because the tube is compressed between the rolls and is made slender. Therefore, as shown in FIG. 1, it is favorable that the constraining force is within 20% of the elasticity limit stress at respective temperature of the workpiece, and more favorable rage is 5 to 15% thereof.

With respect to a method for obtaining the above load ratio (=load stress/elasticity limit stress), it can be obtained by actually measuring force at which residual strain is just to be generated by pressing a tube in diametral direction. Also it can be obtained by calculation from elasticity limit stress on technical references. In this case, the calculation is to obtain compressive force at which maximum stress within the tube becomes the elasticity limit stress.

Figure 4B:
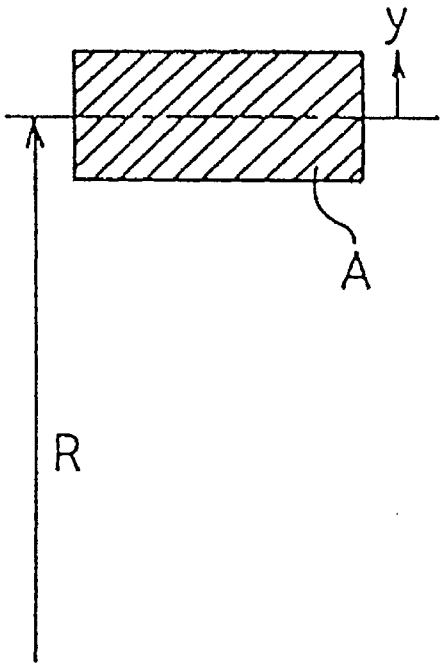
FIG. 4 is explaining calculation of relation between the elasticity limit stress and the constraining force, where (a) is a cross-sectional view of a tube and (b)is a cross-sectional view of a part thereof in a longitudinal direction.
Figure 4A:
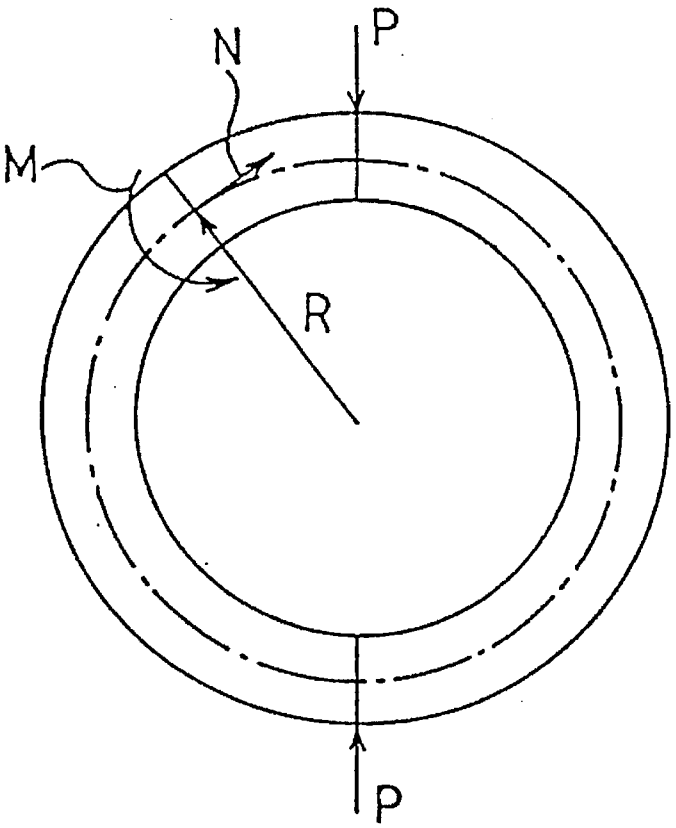

Namely, FIG. 4(*a*) is a cross-sectional view of a tube, and FIG. 4(*b*) is a cross sectional view of a part thereof in a longitudinal direction. Here, it is assumed that axial force N and bending moment M are added to a cross section shown in FIG. 4(*b*), wherein the cross section is at arbitrary place in the circumference of the tube. At this time, the stress $\sigma$ at a distance y from the center line of the cross section (positive toward the tube outside and negative toward the tube inside) is given by general expression (1) of a curved beam, where the cross-sectional area per unit length of a tube in FIG. 4(*b*) is A and the radius of the tube to the center line of the cross section is R.

$$\sigma=\frac{1}{A}\left(N+\frac{M}{R}+\frac{M}{R\kappa}\cdot\frac{y}{R+y}\right) \tag{1}$$

Here, $\kappa$ is cross-sectional coefficient of a curved beam, which is given by expression (2) in a rectangular cross section of thickness 2*h*.

$$\kappa=\frac{R}{A}\int_A\frac{dA}{R+y}-1=-1+\frac{R}{2h}\ln\frac{1+h/R}{1-h/R} \tag{2}$$

Here, in a case where a compressive force is exerted to a tube from the upper and lower sides with force P per unit length thereof as shown in FIG. 4(*a*), it is obvious that a cross section where the maximum stress appears is that where the force P is added. Then the axial force N is zero and the bending moment M is obtained as $M=PR/\{\pi(1+\kappa)\}$, based on a condition that, concerning distortion, inclination of a cross section from the center line (FIG. 4(*a*)) is equal between a place where P is added and a place 90° therefrom owing to symmetry of a tube. M in expression (1) is substituted by this formula, then stress $\delta_o$ at a cross section where a compressive force P is exerted is given by expression (3).

$$\sigma_0=\frac{P}{A\pi(1+\kappa)}\left\{1+\frac{y}{\kappa(R+y)}\right\} \tag{3}$$

In this case P is negative as it is compressive force. A place on the cross section where the maximum stress appears is the place where y is a positive and negative maximum value (±h), that is, the inner and outer surface of the tube. In this case, negative y, namely the tensile stress of the inner surface is greater than positive y, namely the compressive stress of the outer surface. But, difference between them is little, when the thickness 2*h* is small compared with the tube diameter 2R.

Figure 3:
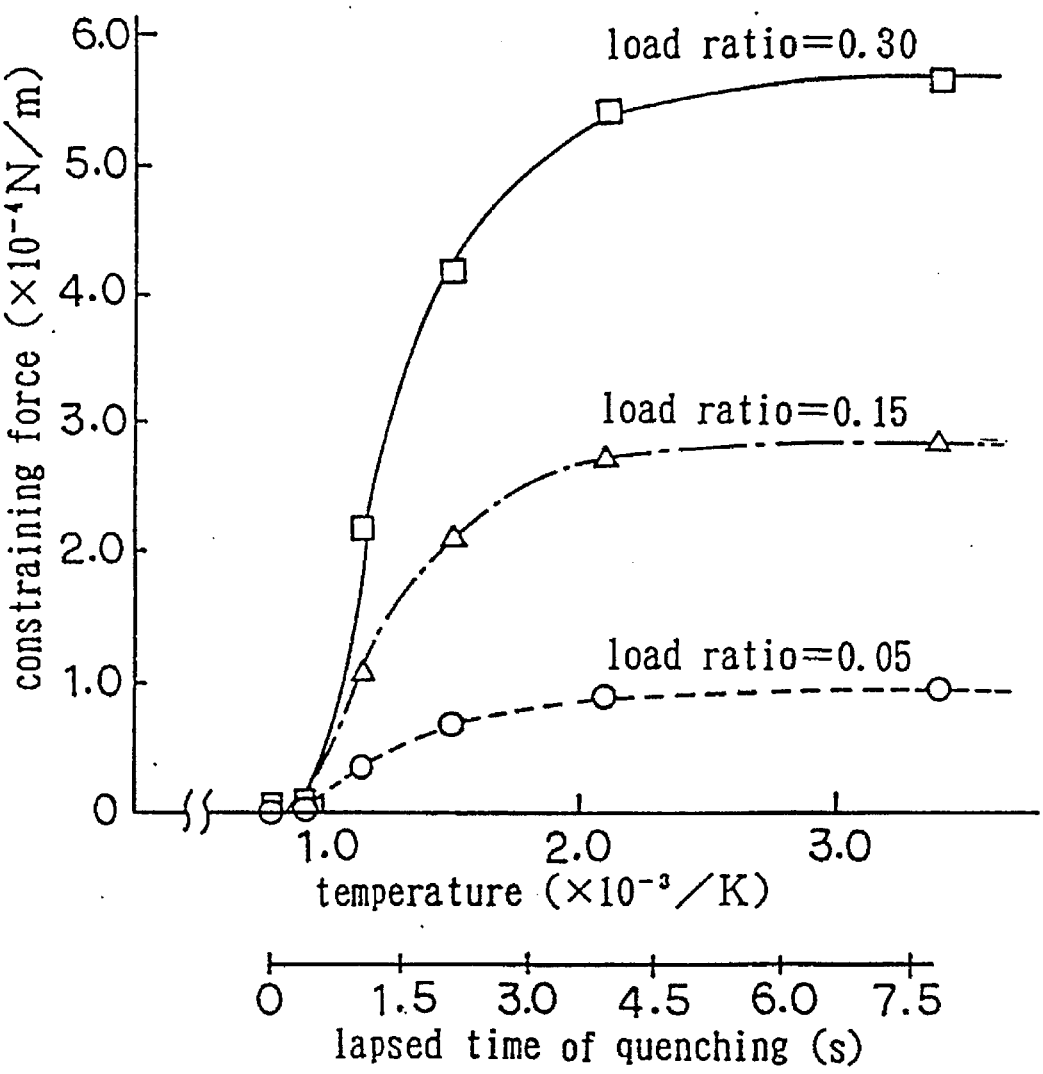
FIG. 3 is a graph showing relation between temperature and constraining force when load ratios are kept constant.

FIG. 3 is a graph showing relation between temperature and constraining force when load ratios are kept constant. An example of lapsed time of quenching in connection with temperature is also shown. Hence, in order to make the load ratio constant, the constraining force must be gradually increased from beginning of the quenching so that the constraining force is in proportion to the elasticity limit stress. In order to change the constraining force in practical quenching work, it is necessary to know temperature change in the quenching process. For this purpose, relation between temperature drop and lapsed time is obtained in advance as shown in FIG. 3, thereby the constraining force is changed depending on the lapsed time of the quenching so that the load ratio is maintained in a predetermined range. As for a method to investigate the relation between the temperature drop and the lapsed time, for instance, the quenching may be done with a thermocouple directly attached to the workpiece.

In most cases, the above method is sufficient which measure temperature transition in relation to the lapsed time in advance, because this invention for quenching a tubular workpiece aims at treating many workpieces of a same shape. However, it is more reliable that the constraining force is changed depending on temperature while actually measuring the temperature of an individual workpiece by a radiation thermometer or the like. This method is favorable because it can easily deal with a case where heating temperature for hardening or cooling conditions are changed by reason of material quality and so on.

Figure 5:
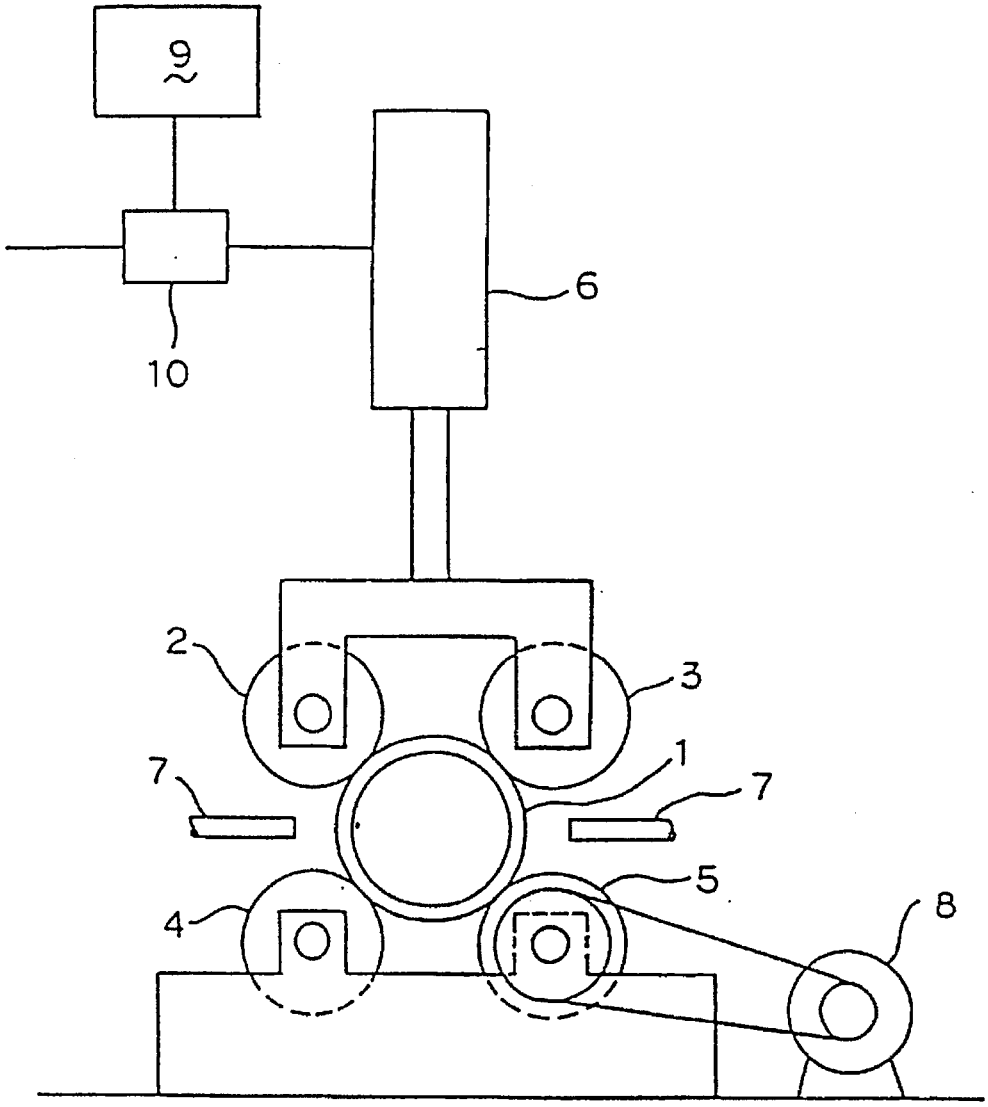
FIG. 5 is a front view of an example of the apparatus according to this invention.

With respect to an apparatus for carrying out this invention's quenching method, in a case of a simple tube workpiece, the apparatus is provided with plural rolls which are in contact along with the workpiece at three or more points on a circumference thereof, whereby the constraining force is exerted by the rotating rolls. In this state, quenching is carried out by a cooling means such as cooling water jetting nozzles. FIG. 5 is a front view showing an example of such a quenching apparatus. 1 is a workpiece, which is heated to hardening temperature by a heating device not shown, and sent into this quenching apparatus. 2, 3, 4, and 5 are pressure rolls, which are simply cylindrical and have a length more than a length of the workpiece, otherwise, which may have intermittent outer surfaces in the longitudinal direction so that the rolls can be partially brought into contact with the workpiece. The rolls which have the intermittent outer surfaces contribute to improving flow of cooling water, but the constraining force must be reduced in accordance with decrease of contact area with the workpiece. Among the pressure rolls, marked 5 is driven to rotate by a motor 8, and the other rolls are possible to rotate freely.

Moreover, the pressure rolls 2, 3 are provided with a oil pressure cylinder 6 to make extendable and retractable. The pressure rolls are pressed to the workpiece, while the constraining force is increased corresponding to increase of elasticity limit stress in accordance with temperature drop of the workpiece. The constraining force can be controlled by adjusting pressure of working oil to be supplied to the cylinder. Therefore, a pressure controller 10 including an oil pressure adjusting valve is actuated by a pressure signal generating means 9 which changes setting input for the pressure in accordance with lapsed time from beginning of the quenching. Instead, temperature of the workpiece during the quenching may be actually measured by a radiation thermometer not shown and so on, then a pressure signal generating means which changes setting input for the pressure in accordance with the measured temperature may be provided. Meanwhile, 7 in the drawing are water jetting nozzles.

The quenching apparatus is not limited to that shown in FIG. 5. For instance, the number of the pressure rolls shown in FIG. 5 is four, but the number of the rolls is unconcerned so long as they are in contact with the workpiece at three or more points on the circumference. Furthermore, nevertheless two pressure rolls extend and retract together in FIG. 5, at least one pressure roll may be made extendable and retractable. Besides, as a pressing means, a pneumatic cylinder may be utilized instead of the oil pressure cylinder for the extending and retracting mechanism of the pressure rolls, and an electromotive cylinder may also be utilized which is equipped with a motor generating necessary force at standstill.

Furthermore, operation of the cylinder by the pressure setting input may be effected based on pressure actually measured by attaching a load cell to a part of the pressing mechanism. In this method high precision control can be attained by adjusting oil or air pressure or voltage of the electromotive cylinder through feedback control based on difference between actual pressure and a set point. Still furthermore, the cooling means is not limited to jetting nozzles shown in FIG. 5, for example, the lower part of the apparatus may be placed in a cooling water tank.

Figure 6:
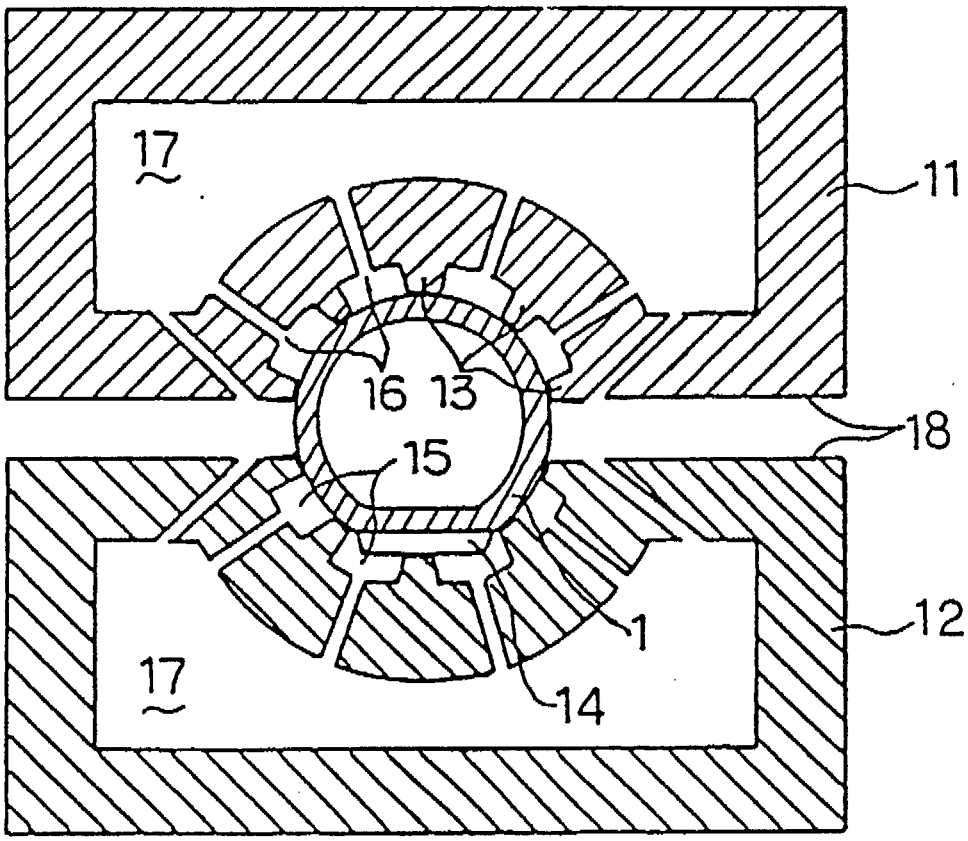
FIG. 6 is a cross-sectional view of an example of the apparatus according to this invention.

Another apparatus shown in FIG. 6 is used besides for a cylindrical tube. Especially for a different-shaped tube which is not simply cylindrical, because such an apparatus as shown in FIG. 5 is not applicable. In FIG. 6, the workpiece 1 has a rack on a longitudinal portion of a cylindrical component. 14 in FIG. 6 is one of the teeth of the rack arranged perpendicular to the face of the figure. This apparatus has an upper die 11 and a lower die 12, which are attached to a pressing means such as a oil pressure press, as later shown in FIG. 7. On inner faces of each dies, projections 13 are arranged to coincide usually with a contour of the workpiece. The projections are continuous in the perpendicular direction of the face of the figure, otherwise, they are intermittently arranged. On the inner faces of the dies, also recesses 15 are arranged between the projections, and into which cooling liquid blow holes 16 are open. Therefore, the recesses communicate with the outside of the dies so that the quenching liquid is smoothly circulated and discharged, or communicate with the adjacent recesses so that the quenching liquid is discharged through them. The cooling liquid blow holes may be formed at least one place of each dies, but the cooling speed can be changed suitably by arrangement of them. 17 in the drawing are cooling liquid supplying chambers and they are connected to a pipe line not shown.

In the apparatus shown in FIG. 6, a method for controlling the constraining force to the workpiece is similar to that described with reference to FIG. 5. In the case where the pressing means is a oil pressure press, the oil pressure cylinder may be controlled as in the apparatus of FIG. 5. Naturally, in order to exert constraining force to the workpiece, the upper and lower dies should not be completely closed to the extent where the die faces 18 are brought into contact with each other. Because the workpiece contracts about 1% in cooling from hardening temperature to normal tem- perature by thermal expansion phenomenon, the contraction must be taken into account concerning dimensions of the dies. Although FIG. 6 shows an example in which a set of dies is divided into two, upper and lower dies, a set of three or more dies is favorable, because the increase of the number of dies makes the direction of the constraining force multiple and more uniform.

Figure 7:
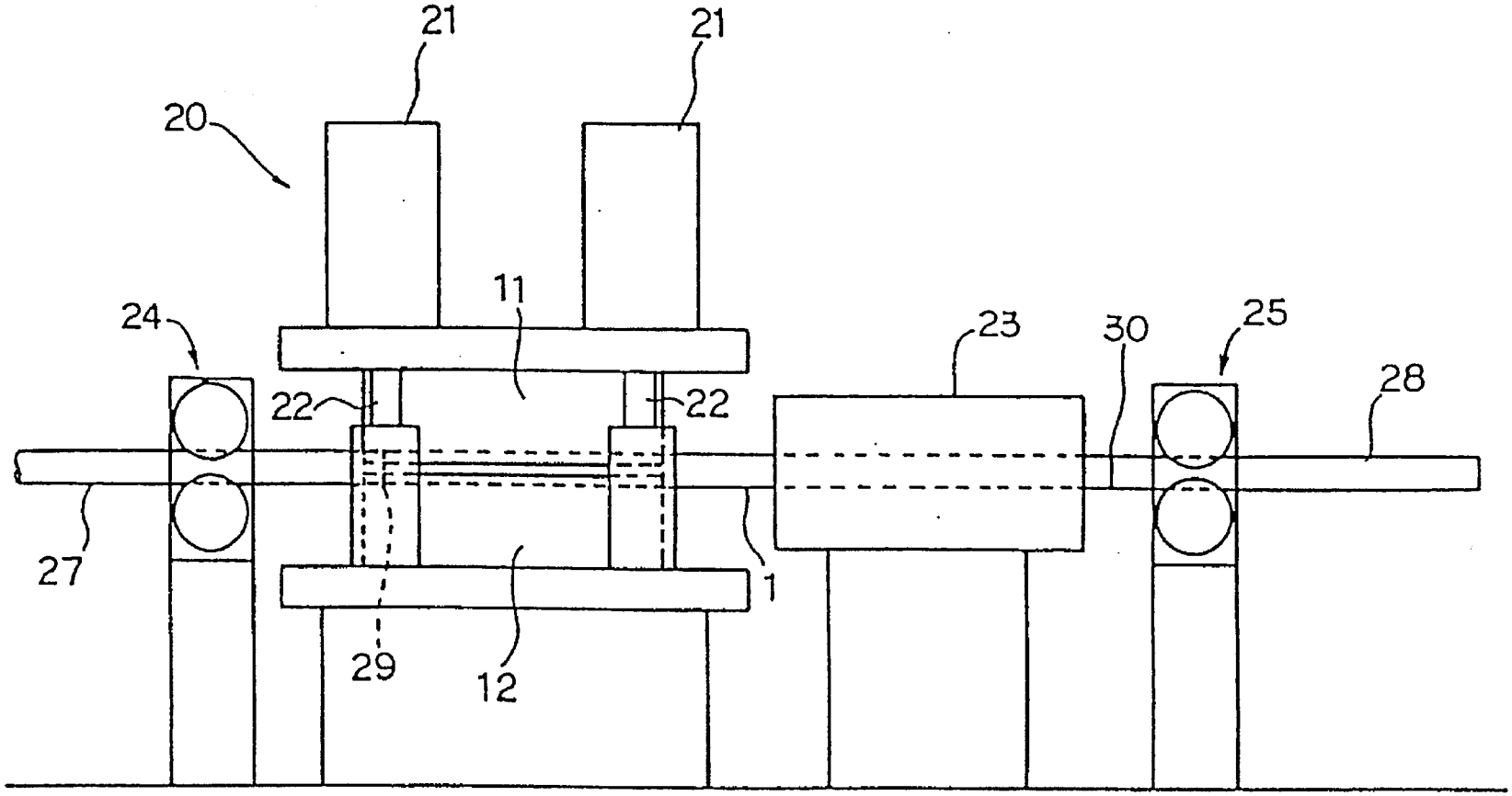
FIG. 7 is a side view of an example of arrangement where the apparatus according to this invention and a heating apparatus are joined together.

The apparatus for quenching a tubular workpiece according to the present invention is disposed in combination with a heating apparatus as an induction heater. FIG. 7 shows an example wherein the apparatus of this invention shown in FIG. 6 is combined with an induction heater. In the drawing, 23 is the induction heater, and 20 is an oil pressure press to which the upper die 11 and lower die 12 shown in FIG. 6 are attached. 21 are oil pressure cylinders by which the upper die 11 is moved vertically, and 22 are piston rods which are driven by the oil pressure cylinders, wherein there are four in each of the piston rods and the cylinders (two of them are located at overlapping positions in the drawing).

The workpiece 1 is fed by feeders 24 and 25 having rollers, then moved to heating and quenching positions. Moreover by adding extension rods to one end or both ends of the workpiece, feeding is made easier and smoother operation is performed in the heating and quenching processes. In the drawing, 27 and 28 are the extensions, wherein 29 and 30 are the jointed places. Moreover, the apparatus shown in FIG. 5 may be added to the arrangement shown in FIG. 7, or naturally the apparatus shown in FIG. 5 may be combined with a induction heater.

EXAMPLE

A steel tube of 25 mm in diameter, 3 mm in thickness, 1,000 mm in length and of a grade equivalent to JIS S35C was heated to 950° C., then it was quenched while changing constraining condition by the apparatus shown in FIG. 5. Then bend and variation in outer diameter were examined. Measurement of the bend was performed whereby the workpiece was rotated with both ends being supported on a knife edge, and deflection was measured by a dial gauge at middle point of the both ends. Hence, flattening of the tube is inclusively measured as bend in this method. Table 1 shows relation between load ratio, bend and variation in outer diameter in the above experiment.

In this example, the constraining force was increased in proportion to increase of the elasticity limit stress in accordance with temperature drop, whereby relation between the temperature and the lapsed time of the quenching was obtained in advance. It can be understood that both of the bend and the variation in outer diameter are small and good when the load ratio, which is a ratio of load stress to elasticity limit stress, is around 0.1 (10%).

TABLE 1

| load ratio | bend (mm) | variation in outer diameter (%) |
|---|---|---|
| 0.05 | 0.40 | 0.033 |
| 0.1 | 0.44 | 0.022 |
| 0.2 | 0.68 | 0.059 |
| 0.3 | 0.95 | 0.15 |
| 1.0 | 5.5 | 2.6 |

As set forth above, by the method for quenching tubular workpiece in the present invention, prevention of warping is attained efficiently without trouble of collapse or decrease of diameter in tubes, whereby the constraining force is small while the workpiece temperature is still high and an elasticty limit stress is small, and the constraining force is increased corresponding to increase of the elasticity limit stress in accordance with temperature drop. Furthermore, the apparatus according to the present invention can deal with a simple cylindrical workpiece, a different-shaped workpiece such as a rack is formed on its side, or a tubular workpiece combined these shapes.

What is claimed is:

1. A method for quenching a tubular workpiece while preventing warping of the workpiece by applying a constraining force, wherein the constraining force is increased from a beginning of the quenching to a termination thereof, corresponding to an increase of an elasticity limit stress of the workpiece due to decrease in the temperature of the workpiece, wherein the constraining force does not exceed 20% of the elasticity limit stress at respective temperatures of the workpiece.

2. A method for quenching a tubular workpiece while preventing warping of the workpiece by applying a constraining force, wherein the constraining force is increased from a beginning of the quenching to a termination thereof, corresponding to an increase of an elasticity limit stress of the workpiece due to decrease in the temperature of the workpiece, wherein the temperature of the workpiece is measured during the quenching, and the constraining force is controlled to change in dependence on the temperature of the workpiece so as to maintain a given range for a ratio of the constraining force to the elasticity limit stress.

3. An apparatus for quenching a tubular-workpiece, comprising plural rolls which are in contact with the workpiece along a length thereof and at three or more points about a circumference thereof; a cooling means for supplying cooling liquid to the workpiece; a pressing means for pressing at least one of the rolls against the workpiece; a thermometer for measuring temperature of the workpiece; a pressure signal generating means for generating a setting input signal in dependence on the temperature measured by said thermometer; and a pressure controller for controlling said pressing means independence on said setting input signal to control the pressure of said at least one roll against the workpiece.

4. an apparatus for quenching a tubular workpiece, comprising a set of dies, each of which has plural projections and plural recesses formed on an inner face thereof; a press removably mounted to said dies for pressing at least one of said dies against the workpiece; cooling liquid blow holds formed in at least one of said dies and opening into said recess; a pressure controller for controlling the pressure of said at least one of said dies against the workpiece by changing a setting input for the pressure during the quenching; a thermometer for measuring temperature of the workpiece and a pressure signal generating means for generating said setting input in dependence on the temperature measured by said thermometer.

5. A method of quenching a workpiece, comprising the steps of:

holding the workpiece in a quenching location;

quenching the workpiece while the workpiece is held in said quenching location;

pressing a pressure member against the workpiece so as to apply a warp constraining force thereto during quenching; and during the quenching step, continuously increasing the warp constraining force applied to the workpiece by adjusting said pressure member to increase the warp constraining force applied thereby against the workpiece in correspondence with an increase of an elasticity limit stress due to a temperature decrease of the workpiece caused by the quenching.

6. A method as recited in claim 5, further comprising predetermining a relationship between temperatures of the workpiece during quenching and the elapsed time of the quenching step; and wherein, in said step of increasing the warp constraining force, the adjusting of the pressure member is carried out in dependence on an elapsed time of the quenching step so as to maintain a given range for a ratio of the constraining force to an elasticity limit stress of the workpiece.

7. An apparatus for quenching a workpiece, comprising:

a holding device for holding the workpiece in a quenching location;

cooling fluid supply means for applying cooling fluid to the workpiece at the quenching location for quenching the workpiece;

a pressure member for pressing against the workpiece so as to apply a warp constraining force thereto during quenching of the workpiece; and pressure control means for, during the quenching step, continuously increasing the warp constraining force applied to the workpiece by adjusting said pressure member to increase the warp constraining force applied thereby against the workpiece in correspondence with an increase of an elasticity limit stress due to a temperature decrease of the workpiece caused by the quenching.

8. An apparatus as recited in claim 7, wherein said holding device comprises a pair of rolls; and said pressure member comprises at least one pressure roll.

9. An apparatus as recited in claim 8, further comprising a pressure signal generating means for generating a setting input signal in dependence on an elapsed time of the quenching of the workpiece, said pressure control means adjusting said pressure member in dependence on said setting input signal.

10. An apparatus as recited in claim 7, wherein said holding device comprises a first die; and said pressure member comprises a second die.

11. an apparatus as recited in claim 10, wherein each of said first and second dies has plural projections and plural recesses formed on an inner surface thereof; and said cooling fluid supply means comprises cooling liquid blow holes formed in at least one of said first and second dies and respectively opening into said recesses thereof.

12. An apparatus as recited in claim 11, further comprising a pressure signal generating means for generating a setting input signal in dependence on an elapsed time of the quenching of the workpiece, said pressure control means adjusting said pressure member in dependence on said setting input signal.

13. An apparatus as recited in claim 7, further comprising a pressure signal generating means for generating a setting input signal in dependence on an elapsed time of the quenching of the workpiece, said pressure control means adjusting said pressure member in dependence on said setting input signal.

* * * * *

UNITED STATES PATENT AND TRADEMARK OFFICE

CERTIFICATE OF CORRECTION

PATENT NO. : 5,626,693
DATED : May 6, 1997
INVENTOR(S) : Yao et al.

It is certified that error appears in the above-identified patent and that said Letters Patent is hereby corrected as shown below:

The title page should be deleted to appear as per attached title page.

Columns 1-10 should be deleted to appear as per attached columns 1-10.

Signed and Sealed this

Thirtieth Day of June, 1998

*Attest:*

Bruce Lehman

BRUCE LEHMAN

*Attesting Officer*

*Commissioner of Patents and Trademarks*

US005626693A

United States Patent [19]

Yao et al.

[11] Patent Number: 5,626,693

[45] Date of Patent: May 6, 1997

[54] METHOD AND APPARATUS FOR QUENCHING A TUBULAR WORKPIECE

[75] Inventors: Yugo Yao; Tetsukazu Fukuhara; Yoshiki Seto; Junichi Kato, all of Hiratsuka, Japan

[73] Assignee: Neturen Co., Ltd., Tokyo, Japan

[21] Appl. No.: 504,755

[22] Filed: Jul. 19, 1995

[51] Int. Cl.[6] ..... C21D 9/08; C21D 1/667

[52] U.S. Cl. ..... 148/594; 148/519; 148/647; 266/117

[58] Field of Search ..... 148/590, 594, 148/519, 646, 647; 266/117, 114

[56] References Cited

U.S. PATENT DOCUMENTS

| | | | |
|---|---|---|---|
| 4,050,963 | 9/1977 | Kunioka et al. . | |
| 4,461,462 | 7/1984 | Mizushima et al. . | |
| 5,492,308 | 2/1996 | Yao et al. | 148/646 |

FOREIGN PATENT DOCUMENTS

| | | | |
|---|---|---|---|
| 0079621 | 5/1983 | European Pat. Off. . | |
| 0172250 | 2/1986 | European Pat. Off. . | |
| 0628641 | 7/1994 | European Pat. Off. . | |
| 0628641 | 12/1994 | European Pat. Off. . | |
| 2602678 | 8/1976 | Germany . | |
| 9001640 | 4/1990 | Germany . | |
| 4316795 | 11/1994 | Germany . | |
| 54-67504 | 5/1979 | Japan . | |
| 5582725 | 6/1980 | Japan | 266/117 |
| 57-192221 | 11/1982 | Japan . | |

*Primary Examiner*—Deborah Yee
*Attorney, Agent, or Firm*—Wenderoth, Lind & Ponack

[57] ABSTRACT

This invention provides a method and apparatus for quenching a tubular workpiece such as a cylindrical tube or a differently-shaped tube, for which it is difficult to exert a constraining force for preventing warping especially in the case of a thin workpiece. Warping is prevented by applying a constraining force which is increased from the beginning of the quenching to the termination thereof, corresponding to an increase of the elasticity limit stress in accordance with temperature decrease of the workpiece. Furthermore, apparatus for carrying out the method for quenching a tubular workpiece are provided with a pressure controller for pressure rolls or dies, whereby the pressure controller changes the pressure exerted on the workpiece during the quenching.

13 Claims, 7 Drawing Sheets

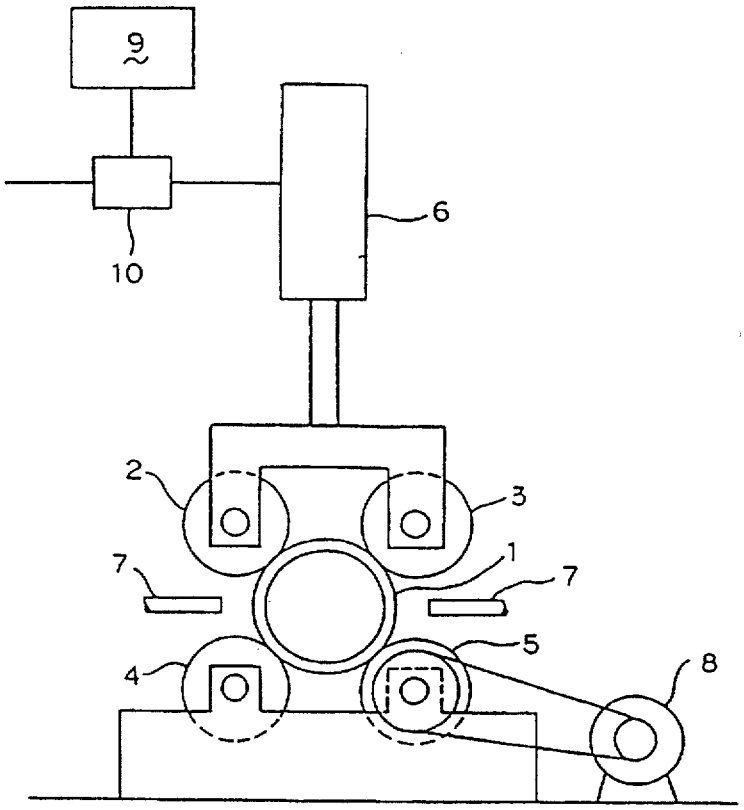

METHOD AND APPARATUS FOR QUENCHING A TUBULAR WORKPIECE

FIELD OF THE INVENTION

The present invention relates to a method and an apparatus for quenching a tubular workpiece such as cylindrical tubes or different-shaped tubes, and especially to a method and an apparatus which are preferably applicable to tubes of thinner thickness for which it is difficult to provide means to prevent warping during quenching.

BACKGROUND ART

In quenching a tubular workpiece which is a thin cylindrical tube, for instance the thickness of which is 3 millimeters, there is a problem that the workpiece is very likely to warp and the diameter thereof may be subjected to change. Various methods by which a workpiece can be quenched with some constraining force have been known for preventing warping during quenching. However, because of the tubes being thin, there are problems in that a portion of the workpiece to which the constraining force is applied becomes concave, and in that the workpiece is elongated in a longitudinal direction by the constraining force applied in a diametral direction.

There is a Japanese laid-open patent No. Sho 57-192221 disclosing a method for quenching a thin tubular workpiece, wherein a tubular workpiece is rotatably supported by both of its end faces, and is made expansible and contractible in the axial direction in heating and cooling processes. Then, groups of rotary disks which are brought into contact with the workpiece at intervals in the longitudinal direction are pressed against the workpiece from two orthogonal directions, to thereby prevent the workpiece from warping and at the same time from dimensional changes by controlling the cooling rate. However, in this method, unless the pressure is sufficiently controlled, the diameter of the workpiece may be partially constricted, because the rotary disks are brought into contact with the workpiece at intervals along the longitudinal direction.

Furthermore, in Japanese laid-open patent No. Sho 54-67504, it is disclosed that a round bar is quenched while among three rolls having a length identical thereto and while being rotated. However, in a case where this method is used for a thin tube, the tube diameter may be reduced and the tube length may be elongated under the usual pressure of the rolls for preventing the tube from warping.

Still furthermore, the above method, wherein the workpiece is rotated during quenching, cannot be adopted for a bar workpiece of a different shape such as one having a rack formed on its side. In this case press quenching has been conventionally applied as a method for preventing warping during quenching. According to this method, all or part of a workpiece, which is heated to an appointed hardening temperature, is pressed in dies having concave portions of an appointed shape, and is placed in a cooling liquid tank. Recently, there are cases where a bar workpiece having a rack formed therealong is made hollow and tubular for the purpose of making automobiles lighter. In these cases, there is a possibility that such a workpiece will be collapsed by compressive force in the above press quenching.

Formerly, the inventors of the present invention had improved the press quenching and had invented an apparatus wherein dies are brought into contact with each other when they are closed, such that no pressure is exerted on the workpiece in the dies (International laid-open patent: 94-14985, EPC laid-open patent No. 0628641). In this apparatus, no pressure is exerted on a workpiece when the workpiece is still soft at high temperature just after the beginning of the quenching, and warping is prevented by the constraining force of the dies.

It is a theme of the present invention that no collapse nor change in diameter should occur, wherein constrained quenching is carried out in order to prevent warping of the tubular workpiece. A method and an apparatus of this invention must be applicable not only to a tubular workpiece in the form of a cylindrical tube, but also to a workpiece of a different shape which has a flat side extending therealong. Also it is an object of the present invention to provide a method and an apparatus which are superior to the former invention in capacity to prevent warping during quenching.

SUMMARY OF THE INVENTION

It is an object of the present invention to provide a method and an apparatus capable of quenching a tubular workpiece without warping or collapsing the workpiece. The method according to the present invention is based on the fact that warping during quenching can be prevented by applying a constraining force. According to the method, the constraining force is increased from the beginning of the quenching to the termination thereof, corresponding to an increase of the elasticity limit stress in accordance with temperature decrease of the workpiece. Preferably the constraining force does not exceed 20%, and is more favorably 5 to 15%, of the elasticity limit stress at a respective temperatures of the workpiece.

The above method for quenching a workpiece further includes the following aspects. The constraining force is changed depending on the elapsed time of the quenching so that a ratio of the constraining force to the elasticity limit stress is maintained in a determined range, whereby relation between the temperature of the workpiece and the elapsed time of the quenching is obtained in advance. Another aspect is that the constraining force is changed depending on the temperature of the workpiece so that a ratio of the constraining force to the elasticity limit stress is maintained in a given range, whereby the temperature of the workpiece is measured during the quenching.

The present invention also offers suitable apparatus for carrying out the above methods. The apparatus for quenching a tubular workpiece according to the present invention comprises plural rolls which are in contact continuously or intermittently along a length of the workpiece at three or more points about a circumference thereof; and a cooling means for supplying cooling liquid to the workpiece, wherein at least one of the rolls is provided with a pressing means, wherein the pressing means is provided with a pressure controller which controls the pressure by changing the setting input to the controller for changing the pressure during the quenching.

Another type of apparatus according to the present invention comprises a set of dies which are removably mounted to a press in order to press the workpiece, wherein plural projections and plural recesses are formed on inner faces of each of the dies; and cooling liquid blow holes are formed in at least one of the dies and open into the recesses, wherein the press is provided with a pressure controller which controls the pressure by changing the setting input to the controller for changing the pressure during the quenching.

Each of the above apparatus for quenching a tubular workpiece further embodies the following aspects. The apparatus further comprises a pressure signal generating means for setting the input to the controller, wherein the value of the pressure signal changes depending on the elapsed time of the quenching. The apparatus may also comprise a thermometer for measuring the temperature of the workpiece, and a pressure signal generating means for generating the setting input wherein the value of the pressure signal depends on the temperature measured by the thermometer.

BRIEF DESCRIPTION OF THE DRAWINGS

FIG. 1 is a graph showing relations between bending of a workpiece, variation in outer diameter and load ratio of a constraining force.

Figure 2:
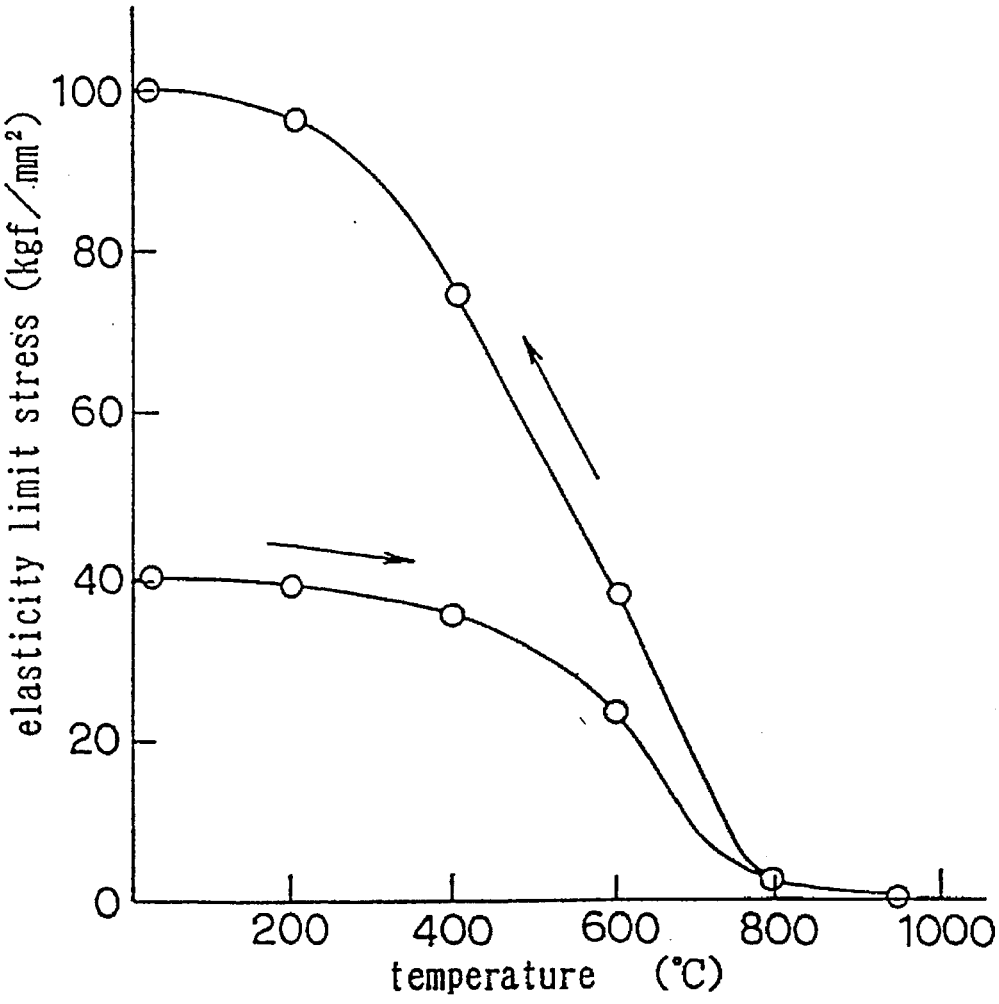
FIG. 2 is a graph showing change of elasticity limit stress due to temperature change by heating and quenching of steel.

FIG. 2 is a graph showing changes of elasticity limit stress due to temperature change by heating and quenching of steel.

FIG. 3 is a graph showing relations between temperature and constraining force when load ratios are kept constant.

FIGS. 4(*a*) and 4(*b*) are views for explaining calculation of relation between the elasticity limit stress and the constraining force, where FIG. 4(*a*) is a cross-sectional view of a tube, and FIG. 4(*b*) is a cross-sectional view of a part thereof in a longitudinal direction.

FIG. 5 is a front view of an example of the apparatus according to this invention.

FIG. 6 is a cross-sectional view of an example of the apparatus according to this invention.

FIG. 7 is a side view of an example of an arrangement where the apparatus according to this invention and a heating apparatus are joined together.

DETAILED DESCRIPTION OF THE INVENTION

In the present invention, a constraining force applied during quenching is changed corresponding to an increase of elasticity limit stress due to a temperature drop of the workpiece. Thereby, warping of the workpiece can be prevented by applying only a remarkably smaller force than that applied in the conventional press quenching, such that no collapse due to the constraining force will occur in the tubular workpiece. The elasticity limit of a material changes remarkably depending on the temperature. As an example, FIG. 2 shows that the elasticity limit stress decreases in accordance with temperature increase and becomes remarkably low around 800° C. On the other hand, the elasticity limit stress again increases upon temperature decrease during the quenching, and it becomes higher than that the elasticity limit stress at the same temperature during the heating due to hardening caused by the quenching. Therefore, in the present invention, the quenching is carried out by maintaining the constraining force within a range of the elasticity limit, whereby the constraining force is increased from beginning to determination of the quenching corresponding to the increase of the elasticity limit in accordance with the temperature drop of the workpiece. The above process makes it possible to exert, against the workpiece, effective constraining force while preventing collapse of the workpiece. In this manner, the constraining force corresponds to the increase of strength due to cooling, and then makes it possible to prevent warping during quenching. For this purpose, a value of load ratio = load stress/elasticity limit stress, is introduced, then the quenching is carried out by maintaining this value within a predetermined range regardless of the temperature.

FIG. 1 is a graph showing relations between bending, variation in outer diameter and load ratio, in quenching a thin steel tube which is constrained by rolls. Although the bending is large when the load ratio is zero with no constraining force exerted, it decreases when constraining force is added, but the bending gradually increases when the load ratio increases as further constraining force is exerted. On the other hand, the variation in outer diameter is little when the load ratio is small, but it increases remarkably when the load ratio exceeds a certain value, because the tube is compressed between the rolls and is made slender. Therefore, as shown in FIG. 1, it is favorable that the constraining force is within 20% of the elasticity limit stress at respective temperature of the workpiece, and a more favorable range is 5 to 15% thereof.

The load ration (=load stress/elasticity limit stress) can be obtained by actually measuring force at which residual strain is just to be generated by pressing a tube in the diametral direction. Also it can be obtained by calculation from elasticity limit stress on technical references. In this case, the calculation is to determine the compressive force at which maximum stress within the tube becomes the elasticity limit stress.

Namely, FIG. 4(*a*) is a cross-sectional view of a tube, and FIG. 4(*b*) is a cross-sectional view of a part thereof in a longitudinal direction. Here, it is assumed that axial force N and bending moment M are added to a cross section shown in FIG. 4(*b*), wherein the cross section is at an arbitrary place in the circumference of the tube. At this time, the stress $\sigma$ at a distance y from the center line of the cross section (positive toward the tube outside and negative toward the tube inside) is given by general expression (1) for a curved beam, where the cross-sectional area per unit length of a tube in FIG. 4(*b*) is A and the radius of the tube to the center line of the cross section is R.

$$\sigma = \frac{1}{A}\left(N + \frac{M}{R} + \frac{M}{R\kappa}\cdot\frac{y}{R+y}\right) \tag{1}$$

Here, $\kappa$ is the cross-sectional coefficient of a curved beam, which is given by expression (2) in a rectangular cross section of thickness 2h.

$$\kappa = \frac{R}{A}\int_A \frac{dA}{R+y} - 1 = -1 + \frac{R}{2h}\ln\frac{1+h/R}{1-h/R} \tag{2}$$

Here, in a case where a compressive force is exerted on a tube from the upper and lower sides with force P per unit length thereof as shown in FIG. 4(*a*), it is obvious that a cross section where the maximum stress appears is that where the force P is added. Then the axial force N is zero and the bending moment M is obtained as $M=PR/\{\pi(1+\kappa)\}$, based on a condition that, concerning distortion, inclination of a cross section from the center line (FIG. 4(*a*)) is equal between a place where P is added and a place 90° therefrom owing to symmetry of a tube. M in expression (1) is substituted by this formula, then stress $\delta_o$ at a cross section where a compressive force P is exerted is given by expression (3).

$$\sigma_0 = \frac{P}{A\pi(1+\kappa)}\left\{1 + \frac{y}{\kappa(R+y)}\right\} \tag{3}$$

In this case P is negative as it is a compressive force. A place on the cross section where the maximum stress appears is the place where y is a positive and negative maximum value (±h), that is, the inner and outer surface of the tube. In this case, negative y, namely the tensile stress of the inner surface, is greater than positive y, namely the compressive stress of the outer surface. But, the difference between them is little when the thickness 2h is small compared with the tube diameter 2R.

FIG. 3 is a graph showing relations between temperature and constraining force when load ratios are kept constant. An example of lapsed time of quenching in connection with temperature is also shown. Hence, in order to make the load ratio constant, the constraining force must be gradually increased from beginning of the quenching so that the constraining force is in proportion to the elasticity limit stress. In order to change the constraining force in practical quenching work, it is necessary to know temperature change in the quenching process. For this purpose, the relation between temperature drop and lapsed time is obtained in advance as shown in FIG. 3, thereby the constraining force is changed depending on the lapsed time of the quenching so that the load ratio is maintained in a predetermined range. As for a method to investigate the relation between the temperature drop and the lapsed time, for instance, the quenching may be done with a thermocouple directly attached to the workpiece.

In most cases, the above method, which measures temperature transition in relation to the lapsed time in advance, is sufficient because this invention for quenching a tubular workpiece aims at treating many workpieces of the same shape. However, it is more reliable that the constraining force is changed depending on temperature while actually measuring the temperature of an individual workpiece by a radiation thermometer or the like. This method is favorable because it can easily deal with a case where heating temperature for hardening or cooling conditions are changed by reason of material quality and so on.

With respect to an apparatus for carrying out this invention's quenching method, in a case of a simple tube workpiece, the apparatus is provided with plural rolls which are in contact along the workpiece at three or more points about a circumference thereof, whereby the constraining force is exerted by the rotating rolls. In this state, quenching is carried out by a cooling means such as a cooling water jetting nozzles. FIG. 5 is a front view showing an example of such a quenching apparatus. 1 is a workpiece, which is heated to hardening temperature by a heating device (not shown), and sent into this quenching apparatus. 2, 3, 4, and 5 are pressure rolls, which are simply cylindrical and have a length greater than a length of the workpiece or, otherwise, may have intermittent outer surfaces in the longitudinal direction so that the rolls can be partially brought into contact with the workpiece. The rolls which have the intermittent outer surfaces contribute to improving the flow of cooling water, but the constraining force must be reduced in accordance with the decrease of contact area with the workpiece. Among the pressure rolls, pressure roll 5 is driven to rotate by a motor 8, and the other rolls are freely rotatable.

Moreover, the pressure rolls 2, 3 are provided with an oil pressure (hydraulic) cylinder 6 to make them extendable and retractable. The pressure rolls are pressed against the workpiece, while the constraining force is increased corresponding to an increase of elasticity limit stress in accordance with the temperature drop of the workpiece. The constraining force can be controlled by adjusting the pressure of the working oil to be supplied to the cylinder. Therefore, a pressure controller 10 including an oil pressure adjusting valve is actuated by a pressure signal generating means 9 which changes the setting input to the pressure controller 10 to cause the pressure to be varied in accordance with time elapsed from beginning of the quenching. Instead, the temperature of the workpiece during the quenching may be actually measured by a radiation thermometer (not shown) and so on, and then a pressure signal generating means may be provided for changing the setting input to the pressure controller 10 to cause the pressure to be varied in accordance with the measured temperature. Meanwhile, reference numeral 7 represents water jetting nozzles.

The quenching apparatus is not limited to that shown in FIG. 5. For instance, the number of the pressure rolls shown in FIG. 5 is four, but the number of the rolls is unimportant so long as they are in contact with the workpiece at three or more points about the circumference. Furthermore, although two pressure rolls extend and retract together in FIG. 5, it is only necessary that at least one pressure roll be made extendable and retractable. Besides, as a pressing means, a pneumatic cylinder may be utilized instead of the oil pressure cylinder for the extending and retracting mechanism of the pressure rolls, and an electromotive cylinder, equipped with a motor to generate the necessary force at standstill, may also be utilized.

Furthermore, operation of the cylinder by the pressure setting input from the pressure signal generating means 10 may be effected based on pressure actually measured by attaching a load cell to a part of the pressing mechanism. In this method high precision control can be attained by adjusting oil or air pressure or voltage of the electromotive cylinder through feedback control based on the difference between the actual pressure and a target pressure. Still furthermore, the cooling means is not limited to the jetting nozzles shown in FIG. 5. In an alternative example, the lower part of the apparatus may be placed in a cooling water tank.

Another apparatus shown in FIG. 6 is used for workpieces other than a cylindrical tube, especially for a differently-shaped tube which is not simply cylindrical, because an apparatus such as shown in FIG. 5 would not be applicable. In FIG. 6, the workpiece 1 has a rack along a longitudinal portion of a cylindrical component. As shown in FIG. 6, the teeth 14 of the rack are arranged perpendicular to the face of the figure. This apparatus has an upper die 11 and a lower die 12, which are attached to a pressing means such as an oil pressure press, as shown in Fig, 7. On inner faces of each of the dies 11 and 12, projections 13 are arranged to coincide usually with a contour of the workpiece. The projections are continuous in the direction perpendicular to the face of the figure; otherwise, they are intermittently arranged. On the inner faces of the dies, recesses 15 are arranged between the projections 13, and cooling liquid blow holes 16 open into these recesses 15. Therefore, the recesses communicate with the outside of the dies so that the quenching liquid is smoothly circulated and discharged, or communicate with the adjacent recesses so that the quenching liquid is discharged through them. The cooling liquid blow holes may be formed in at least one place of each die, but the cooling speed can be changed suitably by the arrangement of the blow holes. Cooling liquid supplying chambers 17 are connected to the blow holes 16 and to a pipe line (not shown).

In the apparatus shown in FIG. 6, a method for controlling the constraining force against the workpiece is similar to that described with reference to FIG. 5. In the case where the pressing means is an oil pressure (hydraulic) press, the oil pressure cylinder may be controlled as in the apparatus of FIG. 5. Naturally, in order to exert a constraining force on the workpiece, the upper and lower dies should not be completely closed to the extent where the die faces 18 are brought into contact with each other. Because the workpiece contracts about 1% in cooling from hardening temperature to normal temperature due to thermal expansion phenomenon, the contraction must be taken into account concerning dimensions of the dies. Although FIG. 6 shows an example in which a set of dies is divided into two, upper and lower dies, a set of three or more dies is favorable, because the increase of the number of dies increases the number of directions in which the constraining force are applied, thereby making the constraining force more uniform.

The apparatus for quenching a tubular workpiece according to the present invention is disposed in combination with a heating apparatus and, in particular, an induction heater. FIG. 7 shows an example wherein the apparatus of this invention shown in FIG. 6 is combined with the induction heater. In FIG. 7, 23 is the induction heater, and 20 is an oil pressure press to which the upper die 11 and lower die 12 shown in FIG. 6 are attached. 21 are oil pressure (hydraulic) cylinders by which the upper die 11 is moved vertically, and 22 are piston rods which are driven by the oil pressure cylinders. There are four each of the piston rods and the cylinders (two of which are located behind the other two in FIG. 7).

The workpiece 1 is fed by feeders 24 and 25 having rollers, and then moved to heating and quenching positions. Moreover by adding extension rods to one end or both ends of the workpiece, feeding is made easier and smoother operation is performed in the heating and quenching processes. In FIG. 7, 27 and 28 are the extensions, wherein 29 and 30 are the jointed places. Moreover, the apparatus shown in FIG. 5 may be added to the arrangement shown in FIG. 7, or naturally the apparatus shown in FIG. 5 may be combined with an induction heater.

EXAMPLE

A steel tube 25 mm in diameter, 3 mm in thickness, 1,000 mm in length and of a grade equivalent to JIS S35C was heated to 950° C., then it was quenched while the constraining condition was changed by the apparatus shown in FIG. 5. Then bending and variation in the outer diameter were examined. Measurement of the bending was performed whereby the workpiece was rotated with both ends being supported on a knife edge, and deflection was measured by a dial gauge at a point midway between both ends. Hence, flattening of the tube is inclusively measured as bending in this method. Table 1 shows relations between load ratio, bending and variation in the outer diameter in the above experiment.

In this example, the constraining force was increased in proportion to the increase of the elasticity limit stress in accordance with temperature decrease, whereby the relation between the temperature and the lapsed time of the quenching was obtained in advance. It can be understood that both of the bending and the variation in the outer diameter are small and good when the load ratio, which is a ratio of load stress to elasticity limit stress, is around 0.1 (10%).

TABLE 1

| load ratio | bend (mm) | variation in outer diameter (%) |
|---|---|---|
| 0.05 | 0.40 | 0.033 |
| 0.1 | 0.44 | 0.022 |
| 0.2 | 0.68 | 0.059 |
| 0.3 | 0.95 | 0.15 |
| 1.0 | 5.5 | 2.6 |

As set forth above, by the method for quenching a tubular workpiece according to the present invention, prevention of warping is attained efficiently without collapsing or decreasing the diameters of the tubes, whereby the constraining force is small while the workpiece temperature is still high and an elasticity limit stress is small, and the constraining force is increased corresponding to an increase of the elasticity limit stress in accordance with temperature decrease. Furthermore, the apparatus according to the present invention can deal with a simple cylindrical workpiece, a differently-shaped workpiece such one having a rack formed on its side, or a tubular workpiece combining these shapes.

What is claimed is:

1. A method for quenching a tubular workpiece while preventing warping of the workpiece by applying a constraining force, wherein the constraining force is increased from a beginning of the quenching to a termination thereof, corresponding to an increase of an elasticity limit stress of the workpiece due to decrease in the temperature of the workpiece, wherein the constraining force does not exceed 20% of the elasticity limit stress at respective temperatures of the workpiece.

2. A method for quenching a tubular workpiece while preventing warping of the workpiece by applying a constraining force, wherein the constraining force is increased from a beginning of the quenching to a termination thereof, corresponding to an increase of an elasticity limit stress of the workpiece due to decrease in the temperature of the workpiece, wherein the temperature of the workpiece is measured during the quenching, and the constraining force is controlled to change in dependence on the temperature of the workpiece so as to maintain a given range for a ratio of the constraining force to the elasticity limit stress.

3. An apparatus for quenching a tubular-workpiece, comprising plural rolls which are in contact with the workpiece along a length thereof and at three or more points about a circumference thereof; a cooling means for supplying cooling liquid to the workpiece; a pressing means for pressing at least one of the rolls against the workpiece; a thermometer for measuring temperature of the workpiece; a pressure signal generating means for generating a setting input signal in dependence on the temperature measured by said thermometer; and a pressure controller for controlling said pressing means independence on said setting input signal to control the pressure of said at least one roll against the workpiece.

4. An apparatus for quenching a tubular workpiece, comprising a set of dies, each of which has plural projections and plural recesses formed on an inner face thereof; a press removably mounted to said dies for pressing at least one of said dies against the workpiece; cooling liquid blow holds formed in at least one of said dies and opening into said recess; a pressure controller for controlling the pressure of said at least one of said dies against the workpiece by changing a setting input for the pressure during the quenching; a thermometer for measuring temperature of the workpiece and a pressure signal generating means for generating said setting input in dependence on the temperature measured by said thermometer.

5. A method of quenching a workpiece, comprising the steps of:

holding the workpiece in a quenching location;

quenching the workpiece while the workpiece is held in said quenching location;

pressing a pressure member against the workpiece so as to apply a warp constraining force thereto during quenching; and during the quenching step, continuously increasing the warp constraining force applied to the workpiece by adjusting said pressure member to increase the warp constraining force applied thereby against the workpiece in correspondence with an increase of an elasticity limit stress due to a temperature decrease of the workpiece caused by the quenching.

6. A method as recited in claim 5, further comprising predetermining a relationship between temperatures of the workpiece during quenching and the elapsed time of the quenching step; and wherein, in said step of increasing the warp constraining force, the adjusting of the pressure member is carried out in dependence on an elapsed time of the quenching step so as to maintain a given range for a ratio of the constraining force to an elasticity limit stress of the workpiece.

7. An apparatus for quenching a workpiece, comprising:

a holding device for holding the workpiece in a quenching location;

cooling fluid supply means for applying cooling fluid to the workpiece at the quenching location for quenching the workpiece;

a pressure member for pressing against the workpiece so as to apply a warp constraining force thereto during quenching of the workpiece; and pressure control means for, during the quenching step, continuously increasing the warp constraining force applied to the workpiece by adjusting said pressure member to increase the warp constraining force applied thereby against the workpiece in correspondence with an increase of an elasticity limit stress due to a temperature decrease of the workpiece caused by the quenching.

8. An apparatus as recited in claim 7, wherein said holding device comprises a pair of rolls; and said pressure member comprises at least one pressure roll.

9. An apparatus as recited in claim 8, further comprising a pressure signal generating means for generating a setting input signal in dependence on an elapsed time of the quenching of the workpiece, said pressure control means adjusting said pressure member in dependence on said setting input signal.

10. An apparatus as recited in claim 7, wherein said holding device comprises a first die; and said pressure member comprises a second die.

11. An apparatus as recited in claim 10, wherein each of said first and second dies has plural projections and plural recesses formed on an inner surface thereof; and said cooling fluid supply means comprises cooling liquid blow holes formed in at least one of said first and second dies and respectively opening into said recesses thereof.

12. An apparatus as recited in claim 11, further comprising a pressure signal generating means for generating a setting input signal in dependence on an elapsed time of the quenching of the workpiece, said pressure control means adjusting said pressure member in dependence on said setting input signal.

13. An apparatus as recited in claim 7, further comprising a pressure signal generating means for generating a setting input signal in dependence on an elapsed time of the quenching of the workpiece, said pressure control means adjusting said pressure member in dependence on said setting input signal.

* * * * *

UNITED STATES PATENT AND TRADEMARK OFFICE

CERTIFICATE OF CORRECTION

PATENT NO. : 5,626,693

DATED : May 6, 1997

INVENTOR(S) : Yugo YAO et al.

It is certified that error appears in the above-identified patent and that said Letters Patent is hereby corrected as shown below:

Column 3, line 47, delete "that";

Column 3, line 53, change "determination" to --termination--;

Column 4, line 13, change "ration" to --ratio--;

Column 8, line 29 (claim 3, line 1), change "tubular-workpiece" to --tubular workpiece--;

Column 8, line 39 (claim 3, line 11), change "independence" to --in dependence--;

Column 8, line 46 (claim 4, line 5), change "holds" to --holes--;

Signed and Sealed this

Thirtieth Day of May, 2000

*Attest:*

Q. TODD DICKINSON

*Attesting Officer*

*Director of Patents and Trademarks*